US009403400B2

(12) United States Patent
McManus et al.

(10) Patent No.: US 9,403,400 B2
(45) Date of Patent: Aug. 2, 2016

(54) MODULAR PORTABLE WRITING AND PROJECTION SYSTEM HAVING VARIABLE CURVATURE

(75) Inventors: Michael McManus, Oaklade, PA (US); Stephen Spencer, Pittsburgh, PA (US); Donald MacDonald, Pittsburgh, PA (US); John Crowley, Pittsburgh, PA (US); Joseph Ballay, Pittsburgh, PA (US)

(73) Assignee: MAYA DESIGN, INC., Pittsburgh, PA (US)

( * ) Notice: Subject to any disclaimer, the term of this patent is extended or adjusted under 35 U.S.C. 154(b) by 112 days.

(21) Appl. No.: 12/860,037

(22) Filed: Aug. 20, 2010

(65) Prior Publication Data

US 2011/0045454 A1 Feb. 24, 2011

Related U.S. Application Data

(60) Provisional application No. 61/235,594, filed on Aug. 20, 2009.

(51) Int. Cl.
*B43L 1/00* (2006.01)
*A47B 97/04* (2006.01)
(Continued)

(52) U.S. Cl.
CPC . *B43L 1/00* (2013.01); *A47B 97/04* (2013.01); *B43L 1/08* (2013.01); *B43L 1/10* (2013.01)

(58) Field of Classification Search
CPC ..... B43L 1/00; B43L 1/08; B43L 1/123; A47B 97/02; A47B 97/04; A47G 5/00; A47G 5/02; G09F 15/00; G09F 15/0006
USPC ..... 434/365, 408, 413–416, 421, 425; 160/135
See application file for complete search history.

(56) References Cited

U.S. PATENT DOCUMENTS 1,706,388 A * 3/1929 Ashkenas ..... A47G 5/00 160/135
1,744,605 A * 1/1930 Ashkenas ..... A47G 5/00 160/135

(Continued)

FOREIGN PATENT DOCUMENTS

KR 10-1987-0005826 7/1987
KR 10-1997-0000544 1/1997
KR 20-1998-0025991 8/1998

OTHER PUBLICATIONS

Walltalkers tac-wall® surface, from Walltalkers website, undated, 1 page, seen at http://www.walltalksers.com/products/tac-wall.asp.

(Continued)

*Primary Examiner* — Gene Kim
*Assistant Examiner* — Alyssa Hylinski
(74) *Attorney, Agent, or Firm* — GTC Law Group PC & Affiliates

(57) ABSTRACT

A modular, portable writing and projection system having a variable curvature is disclosed. The system uses dry erase boards, chalk or black boards, or other flexible panels having at least one writing surface. The panels have edges for joining to posts. The system combines panels to form a large, modular system for use at meetings, gatherings or other assemblies. The system allows a large number of users to contribute to a presentation, and also allows users to view the presentation. Because the panels are flexible, the system may be curved, allowing more panels to be mounted, used, written on and viewed, within limited space. The panels may be used in either a convex or concave manner, i.e., curved in or curved out, as desired. The resistance of the panels to remaining in a curved state is overcome by feet on the posts and braking or holding devices on the feet.

24 Claims, 6 Drawing Sheets

(51) Int. Cl.
*B43L 1/08* (2006.01)
*B43L 1/10* (2006.01)

(56) References Cited

U.S. PATENT DOCUMENTS 2,324,398 A * 7/1943 Kahr ..... A47G 5/00 135/119
2,577,667 A * 12/1951 Waite ..... A47G 5/00 139/416
2,838,853 A * 6/1958 Batzdorff ..... B43L 1/06 434/421
3,326,505 A * 6/1967 Jamar, Jr. ..... E04B 2/7425 211/189
3,605,851 A * 9/1971 Miles et al. ..... E04B 2/74 160/135
3,713,474 A * 1/1973 Orlando ..... E04B 2/7409 160/351
3,766,692 A * 10/1973 Stark ..... E04B 2/7444 160/135
D257,606 S * 12/1980 Cyplik ..... D6/332
5,361,164 A 11/1994 Steliga
D353,946 S * 1/1995 Fischer ..... D25/58
5,826,639 A * 10/1998 Miller ..... E09F 15/0068 160/135
5,875,597 A * 3/1999 Gingrich ..... A47G 5/02 160/135
5,903,992 A * 5/1999 Eisenberg ..... G09F 1/12 40/605
5,915,807 A 6/1999 Ilagan et al.
D415,901 S * 11/1999 Arko ..... D6/332
6,251,500 B1 6/2001 Varga
6,292,830 B1 * 9/2001 Taylor ..... G06N 5/043 709/224
6,354,227 B1 3/2002 Feldpausch
6,516,571 B1 * 2/2003 Overthun ..... A47G 5/00 160/351
7,195,491 B1 * 3/2007 Chen ..... B43L 1/00 434/408
7,399,184 B2 7/2008 Hester
7,866,074 B2 * 1/2011 McComb ..... B43K 23/001 160/135
8,596,600 B2 * 12/2013 Spencer ..... A47B 97/001 248/447.1
2004/0091849 A1 * 5/2004 Gallant ..... A47B 97/001 434/408
2004/0140066 A1 * 7/2004 Brennan ..... A47B 97/00 160/351
2006/0003307 A1 * 1/2006 Hester ..... B43L 1/00 434/408
2007/0006498 A1 * 1/2007 Collins ..... G09F 1/06 40/610
2007/0261613 A1 * 11/2007 Watson ..... A47B 3/0803 108/146
2008/0190043 A1 * 8/2008 Beckmann ..... A47H 21/00 52/64
2009/0233265 A1 9/2009 Budryk et al.
2009/0238853 A1 * 9/2009 Liu ..... A61L 27/3633 424/423

OTHER PUBLICATIONS

Walltalkers mag-rite® II surface, from Walltalkers website, undated, 1 page, seen at http:/www.walltalkers.com/products/mag-rite-ii.asp.

International Search Report, PCT/US2010/046100, Mailed May 20, 2011, 3 pages.

* cited by examiner

MODULAR PORTABLE WRITING AND PROJECTION SYSTEM HAVING VARIABLE CURVATURE

PRIORITY CLAIM

The present application claims priority from, and the benefit under 35 U.S.C. §119(e) for, U.S. Provisional Application No. 61/235,594, of the same title, filed on Aug. 20, 2009, which is hereby expressly incorporated by reference.

FIELD

The field of the disclosure is portable non-permanent writing surfaces, portable projection surfaces, and combinations thereof. More specifically, the field of the invention is for a collaborative board-writing system having a flexible writing surface of a variable curvature. The surface may also be a projection surface.

BACKGROUND

Gatherings of people, such as meetings, are useful for discussions on many topics. These gatherings are enhanced if there is a semi-permanent, erasable method for writing down ideas, talking points, qualifications, or other data pertinent to the discussion. An example is a high school or college classroom, in which a professor will write down the main points, for example, for the lesson of the day. Other examples include sales meetings, in which salesmen or sales managers may list products and their respective advantages. Still another example is a "poster board" session common at scientific or engineering meetings. These poster board sessions allow presenters to list topics, data or data points, ideas for a next stage of development, and so forth. The media used in these meetings may include "white board" or dry erase products, such as those available from Sanford Corp., Bellwood, Ill. Other media may include black boards, i.e., boards using chalk to express an idea. Still other media may include opaque plastic sheeting that accepts writing.

In larger meetings especially, or in those with a high interest in a particular topic, board space or presentation space may be in short supply compared to the number of participants or hopeful participants. Thus, it is common for meeting sites or gatherings to furnish many such boards. Each unit furnished is typically a single board, such as a dry erase board, a chalk board or even a smart board, which may be computer controlled and capable of "remembering" what is written and even downloading the written images for later print out in a smaller medium, e.g., one or more sheets of paper. Of course, such smart boards are very expensive and may not be affordable for smaller organizations.

The other typical solution, as mentioned, is to furnish many single boards, which may then be formed in a line for longer presentations, or joined to make a straighter line, which may present topics, ideas or data in a desired sequence. One problem with this method is that it may require many boards to convey all the information presented, and the line of single boards may thus be rather long. Making the line shorter can be accomplished by forming an arc with the boards, i.e., aligning the boards in a polygonal shape (as viewed from above). This also presents problems, because it is easy to mis-align the panels and a broken, disjointed presentation is not as easy to follow. Moreover, as the overall length of the "line" of boards increases, the distance between the viewer and the far edges of the boards also increases, in many cases to the point where the viewer will have difficulty viewing the material written on the edges of the board.

What is needed is a better way of presenting information, especially information that requires several panels or boards, such as those intended for large gatherings. These and other advantages of the disclosure, as well as additional inventive features, will be apparent from the description provided herein.

BRIEF SUMMARY

One embodiment is a portable and modular board writing system. The system includes a flexible panel having a first edge and a second edge and a smooth surface adapted for non-permanent writing on at least one side of the flexible panel. The system also includes a first post secured to the first edge of the flexible panel, a second post secured to the second edge of the flexible panel, a first foot oriented orthogonally to the first post and secured to an end of the first post, and a second foot oriented orthogonally to the second post and secured to an end of the second post. In this embodiment, an outer side of each of the first and second posts is adapted to engage with outer sides of a third post of an adjacent flexible panel, wherein the flexible panel and the adjacent flexible panel form a writing system having a variable curvature, and wherein the first and second feet provide sufficient resistance to prevent movement of the feet due to curvature of the panels.

Another embodiment is a portable and modular board writing system. The system includes at least one flexible panel having a first edge and a second edge, and the flexible panel also includes a smooth surface adapted for non-permanent writing on at least one side of the flexible panel. The system also includes a plurality of posts secured to the first edge and second edge of the at least one flexible panel, wherein the number of posts is equal to the number of flexible panels plus at least one additional post. In this embodiment, there is also a first foot oriented orthogonally to a first post of the plurality of posts and secured to an end of the first post and a second foot oriented orthogonally to a second post of the plurality of posts and secured to an end of the second post, wherein the at least one flexible panel forms a writing system having a variable curvature and wherein the first and second feet provide sufficient resistance to prevent movement of the feet due to curvature of the panels.

Another aspect is a method for providing a modular, portable writing and projection system having variable curvature. The method includes steps of providing at least two flexible panels, each flexible panel having left and right edges and a smooth surface adapted for non-permanent writing on at least one side of the flexible panel. The method also includes steps of securing posts to the left and right edges of each panel, each post having a foot oriented orthogonally to the post; mounting a stopping or securing mechanism to each foot, and arranging the panels, posts and feet to form a system with a desired curvature, wherein the feet provide sufficient resistance to prevent movement of the feet due to curvature of the panels.

Other embodiments and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. The drawings are meant to be illustrative rather than limiting. In the drawings.

While the invention will be described in connection with certain embodiments, there is no intent to limit it to those embodiments. The intent is to cover all alternatives, modifications and equivalents as included within the spirit and scope of the invention as defined by the appended claims. All references, including publications, patent applications, and patents cited herein are hereby incorporated by reference to the same extent as if each reference were individually and specifically indicated to be incorporated by reference and were set forth in its entirety herein.

DETAILED DESCRIPTION

Figure 1:
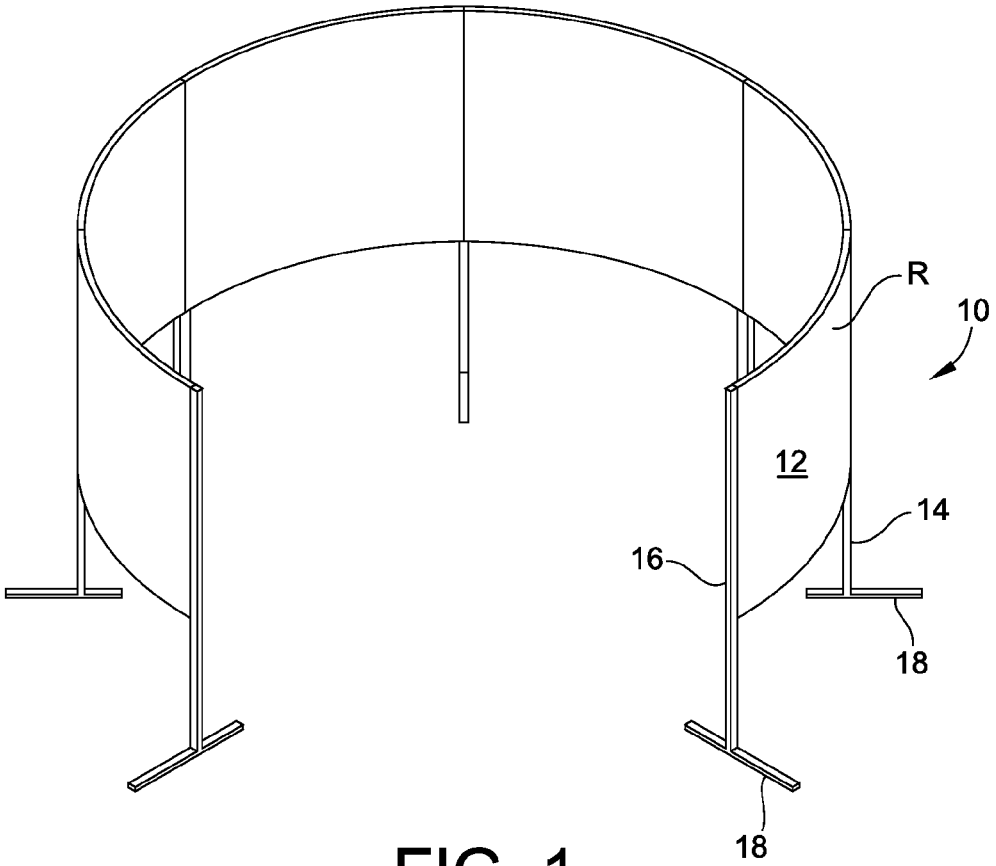
FIG. 1 depicts a perspective view of an embodiment of a modular portable writing and projection system having variable curvature.

FIG. 1 shows an embodiment of the invention wherein several modules are connected together to create an extended module. As will be described in more detail below, each module is flexible. Thus, each module has a variable radius and is easily manipulated into various configurations. As can be seen in FIG. 1, when several flexible modules having various radii are connected together, an extended board writing system having its own variable radius R can be created. In one embodiment, a radius of the extended board system has a minimum diameter of about 10 feet (about 3 meters) and radius R of half that distance.

For purposes of this description, a module is itself a portable, flexible writing surface having a variable radius. The modules can be connected to form an extended board-writing system as described above. Each module comprises a panel. The panel is flexible, but also provides structural integrity to the module. In an embodiment, the panel comprises two layers. The first such layer can be made of a material such as hardboard, which is commonly known as "Masonite." The first layer can also be made of polycarbonate, polyethylene, HDF, high-density polyethylene ("HDPE"), medium density fiberboard (MDF), or the like. The second layer is affixed to the first layer by various conventional means, including by way of an adhesive or lamination process. The second layer can be made of a material or coating which allows for application of non-permanent writing by, for example, dry-erase markers, or for a projection surface. An example of suitable dry erase writing surfaces, projection surfaces, or combination surfaces are those sold under the trademark Walltalker®. Walltalker® is a division of RJF International Corporation of Fairlawn, Ohio.

In other embodiments, the panel could also be one piece of material that provides both the structural integrity and the writing and projection surface. In such an embodiment, the panel is made of high-density polyethylene ("HDPE") or any other materials described above that is used in the first layer, provided such materials facilitate non-permanent writing and/or projection. In still another embodiment, the panel could similarly be one piece of material that provides both the structural integrity and the writing projection surface wherein the material is what is commonly referred to as "showerboard." In still another embodiment, the panel may be made of a shape memory material or a bendable foam, each of which would facilitate non-permanent writing and/or projection, or would be coated with a material that would facilitate the same. The skilled artisan will appreciate that there are other materials from which the panel could be made and that this disclosure does not necessarily limit embodiments to the above-described materials.

FIG. 1 depicts an embodiment of a modular portable writing and projection system having variable curvature 10. As seen in the figure, the system 10 includes a plurality of flexible panels 12, each panel supported by two posts 14, each post having a transverse or orthogonal foot 18. Panels 12 in this embodiment have a single writing surface, on the inside of the circle in the figure. The panels are arranged, in this embodiment, with the panels and their smooth or writing surfaces arranged in a concave, or "curved-in" manner. Persons desiring to write on the panels or to read the panels will move to the inside of the system. The concave embodiment provides a temporary enclosure within which a collaborative meeting may take place. Participants may sit inside the temporary enclosure and use the functional surface of the modules while they are engaged in collaboration. In this sense, the invention provides an annular or curved enclosure having a writing surface on the inner side of the enclosure. The panels and posts may be arranged in a curved, concave manner to provide the enclosure, with sufficient panels and posts to form a temporary enclosure of 180° (as shown in FIG. 1), 270°, other desired degree of enclosure, or even a 360° circle.

In other embodiments, the panels and writing surfaces may be arranged in a convex or "curved-out" manner. In yet another embodiment, the panels may have writing surfaces on both sides.

Figure 2A:
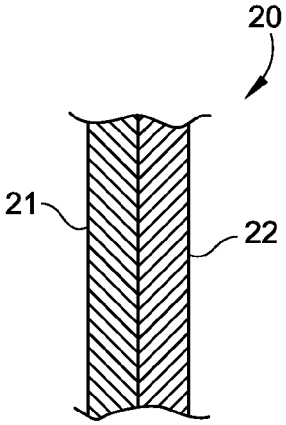
FIGS. 2A and 2B depicts cross sections of several embodiments of flexible panels used in the modular portable writing and projection system.
Figure 2B:
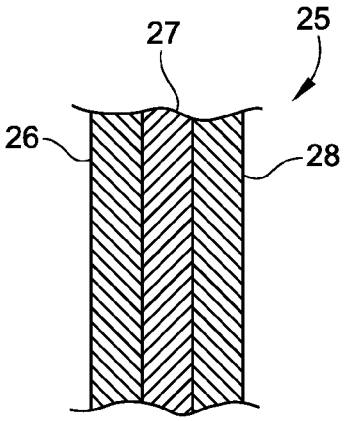
Figure 3:
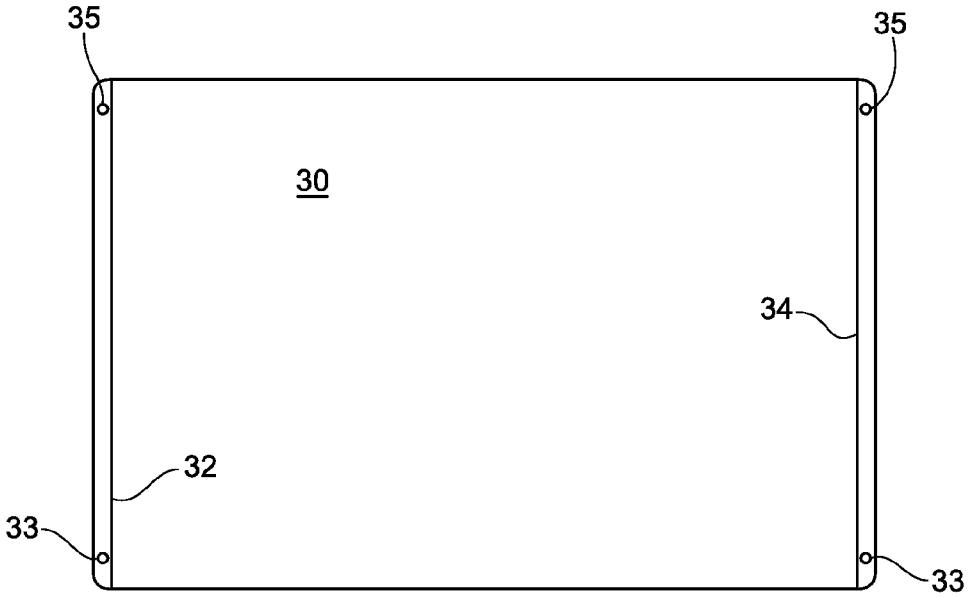
FIG. 3 depicts a front view of a flexible panel with edges.

FIGS. 2A and 2B depict two embodiments of panels with writing surfaces. FIG. 2A depicts a flexible panel 20 having a structural or underlayer 21 and a writing surface 22. FIG. 2B depicts a flexible panel 25 having a central structural layer 27 and writing surfaces 26, 28 on either side of the structural layer. Using flexible panels with writing surfaces on both sides allows for presentation on both sides simultaneously, while still saving space with a curved arrangement, in which the curvature may be easily varied. FIG. 3 depicts a frontal view of another embodiment of a flexible panel 30. Flexible panel 30 has edges 32, 34 on the left and right sides, respectively. The edges include lower orifices 33 and upper orifices 35, for mounting to the posts discussed above.

As FIG. 1 shows, each post is affixed to a support 18 or "foot." In this embodiment, the foot is oriented orthogonally to the post and thus provides the support to keep the module upright. In this embodiment, it is also observed that each post serves to support two adjacent panels, except for the endpost 16, which supports only a single panel.

Panels made from the materials described above are able to flex, but exert a force counter to the desired curvature to get back to their normal "flat" state. It is desirable to have panels that can also be flat because certain situations call for a flat writing or projecting surface. However, it is the variable curvature of the panels that allows the system to be modified into various shapes that foster collaborative communication.

Thus, two aspects are important in achieving variable curvature: the flexibility of the panel (described above), and a way to maintain the curvature in light of the force mentioned above. Two ways to maintain the curvature are as follows: first, a solid connection with the ground which will maintain the curvature and resist the force exerted by the panel to return to its native state, and second, a mechanical means to exert the force necessary to maintain the curvature. As discussed below, many of the mechanical devices used to exert this force are turn-down devices, i.e., some portion of the device is turned or rotated into contact with the ground or a floor on which the posts and feet are mounted.

With respect to the first method mentioned above, an effective way to counteract the force to return to normal described above and thereby to maintain curvature is to create a solid connection with the ground. There are several ways to achieve such a connection. One way is to provide heavily weighted feet. The weight of the feet will be chosen so as to counteract the force to return to normal (or flat). Another such method within this category of creating a solid connection with the ground is to apply external weights to the feet or legs. Another method is to provide the feet with stoppers. In this embodiment, the stoppers could be made of rubber or similar material and when placed on certain floor surfaces, will maintain the curvature of the boards via the friction created. Another mechanism is lockable wheels or casters. The wheels or casters allow the module to be mobile and also allow the module to maintain its curvature via friction once they are locked.

Figure 4:
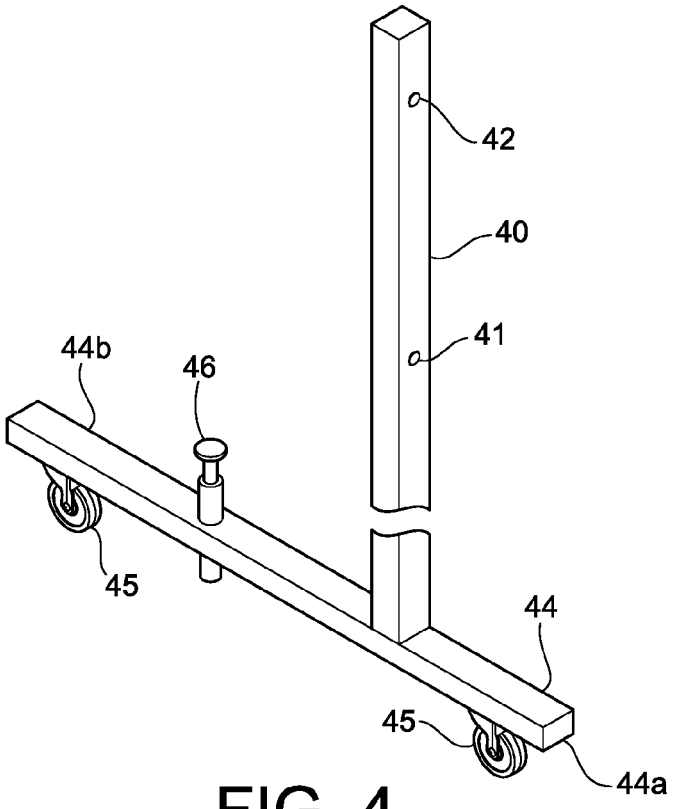
FIG. 4 depicts a first embodiment of a post useful for securing one edge of a flexible panel.

Embodiments with these solutions are depicted in FIGS. 4-9. FIG. 4 depicts a post 40 intended for use with a single edge of a single flexible panel as discussed above. Post 40 includes a lower orifice 41 and an upper orifice 42, for use with fasteners or other devices in conjunction with a flexible panel and its edges and upper and lower orifices. Post 40 includes a foot 44 having a short side 44*a* and a long side 44*b*. The foot short side 44*a* is typically paired with the side of the flexible panel having the writing surface to enable closer approach by persons writing on or viewing the writing surface. Foot 44 is moved with casters 45 and is stopped and retained in place with a plunger-type foot lock 46.

Figure 5:
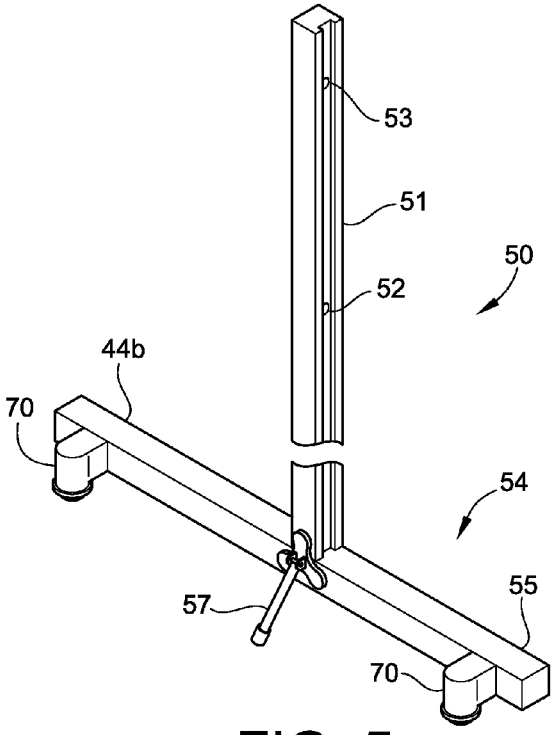
FIG. 5 depicts a second embodiment of a post useful for securing one edge of a flexible panel.

Another embodiment of a post is depicted in FIG. 5. Post 50 is also intended for use with a single edge of a single flexible panel. Post 50 includes a vertical portion 51 and a foot 54. Vertical portion 51 includes lower and upper orifices 52, 53 for use in mounting a flexible panel. Foot 54 includes a long portion 55 and a short portion 57. Each portion includes a ball bearing caster 70, described in FIG. 7. Ball bearing caster 70 is used to allow movement of a mounted flexible panel, and is equipped with a braking mechanism to keep the foot, post and panel in place. Post 50 is also equipped with a kick-down holder 57, to assist in resisting movement.

Figure 6:
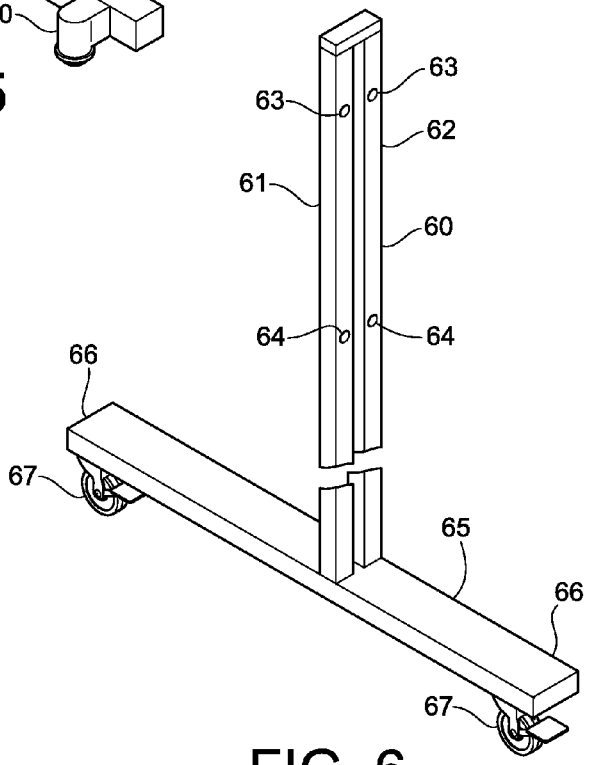
FIG. 6 depicts an embodiment of a post useful for securing a first edge of a first panel and a second edge of an adjacent second panel.

Another embodiment of a post is depicted in FIG. 6. Post 60 is adapted for use with a first edge of one flexible panel and a second edge of an adjacent flexible panel. Post 60 includes a left side 61 and a right side 62, both sides including upper and lower orifices 63, 64 for use with fasteners and corresponding orifices of flexible panels. Foot 65 has two sides 66, each equipped with a locking caster 67 to prevent motion of the foot and the post.

Figure 7A:
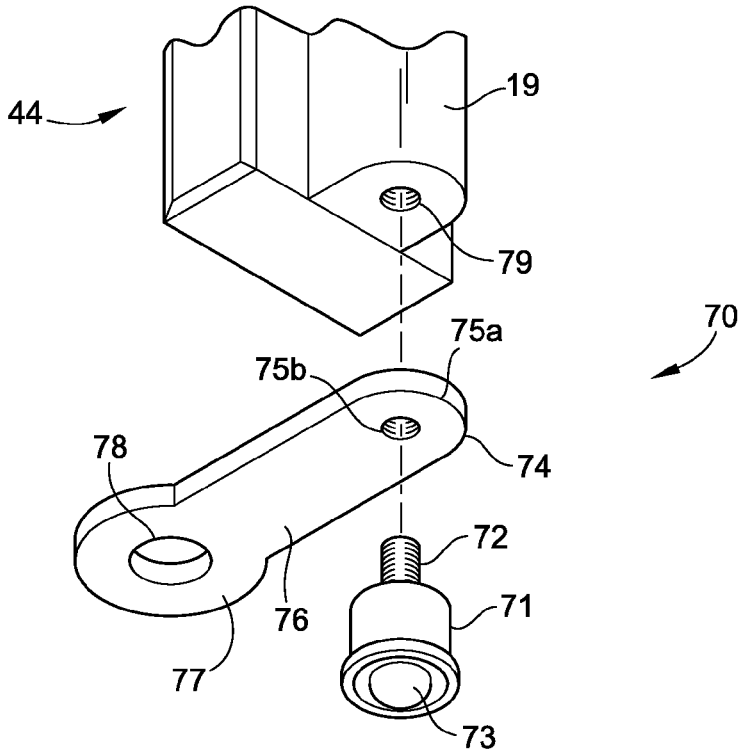
FIGS. 7A and 7B depict a first embodiment of a holding mechanism useful for preventing movement of a foot and post used in the modular portable writing and projection system.
Figure 7B:
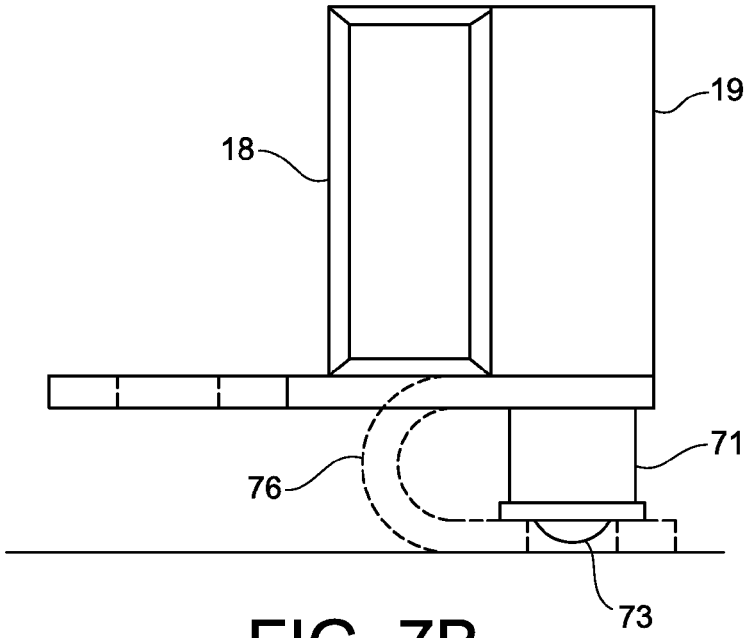

FIGS. 7A and 7B depict an exploded view of ball bearing caster 70, which is intended for mounting to foot 44 via ball bearing caster mount 19, and in this embodiment, with threaded hole 79 in mount 19. The device is very simple. Ball bearing caster 70 includes a housing 71 and a threaded fastener 72 for installation in threaded hole 79. Protruding underneath housing 71 is a roughly hemispherical bearing 73. The assembly also includes a rubber brake 74 with a proximal end 75*a*, a mounting orifice 75*b* and a distal end 77 in a general shape of a cylinder. Bearing 73 may be a very hard material, such as a stainless steel, glass or ceramic, with a very low coefficient of friction. This allows the user to move the posts and panels with relative ease by sliding on the bearing.

When the user desires to lock the post in place, the rubber brake is employed in the following manner. The rubber brake 74 is turned down along length 76 and the distal end 77 is placed under the bearing 73, using orifice 78. As seen in FIG. 7B, this lifts the bearing 73 off the floor. So long as the rubber brake has a reasonably high coefficient of friction, the post or foot is "locked in place," until the brake is removed, thus allowing bearing 73 to again contact the floor or other surface. The brake may be made of molded, extruded or laser-cut rubber, or other material with a reasonably high coefficient of friction.

Figure 8A:
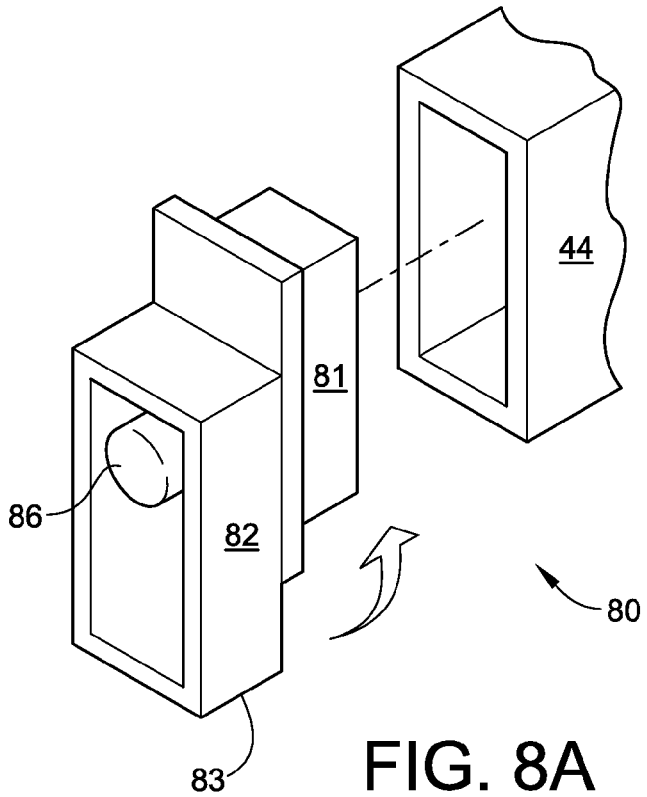
FIGS. 8A and 8B depict a second embodiment of a holding mechanism useful for preventing movement of a foot and post.
Figure 8B:
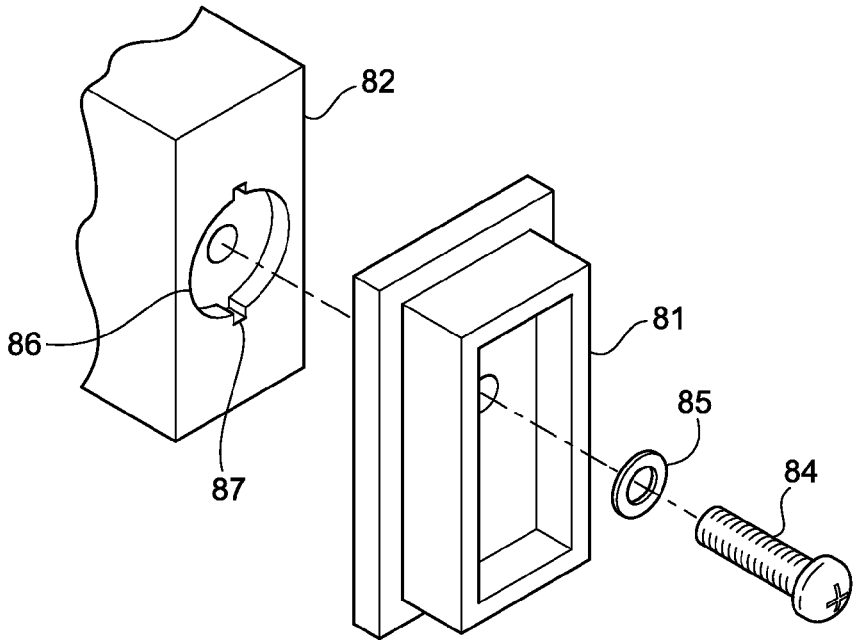

Other mechanisms may also be used to brake and hold the mounted panels, as shown above in FIGS. 4-6 and as shown below in FIGS. 8A, 8B and 9. In FIGS. 8A and 8B, a modified end cap and brake 80, a braking end cap, is attached to an end of foot 44 and is used as a brake or stop. Foot 44 may be a hollow extrusion, as shown, into which a distal portion 81 of the end cap fits snugly. As shown in the figures, the end cap distal and proximal portions 81, 82 are secured by fastener 84, washer 85 and nut 86. Fastener 84 is secured to the foot by a tab, a flange or other convenient means for securing the fastener to foot 44. Proximal portion 82 includes a cylindrical hollow 86 with slots 87 oriented at 180° from each other. The bottom 83 of the proximal portion provides a brake for foot 44.

Not seen in distal portion 81 is a matching cylindrical protrusion with tabs oriented at 180° from each other, the protrusion facing in the direction of the hollow and intended for assembly thereinto. A coil spring with a low spring constant may be mounted within hollow 86 or around the cylindrical protrusion of the distal portion. The spring provides tactile feedback to a user when the user rotates the proximal portion in a clockwise manner so that the bottom 83 brake is on the floor or other surface. The user is about to release the brake by rotating the proximal portion in a counter-clockwise manner, as shown in FIG. 8A. Not shown in FIGS. 8A and 8B is a nearby wheel, caster or caster bearing assembly, used to move the foot and post to which foot 44 is attached. When brake 83 is removed from the floor, the foot 44 will rest on the floor via a wheel or caster.

Figure 9:
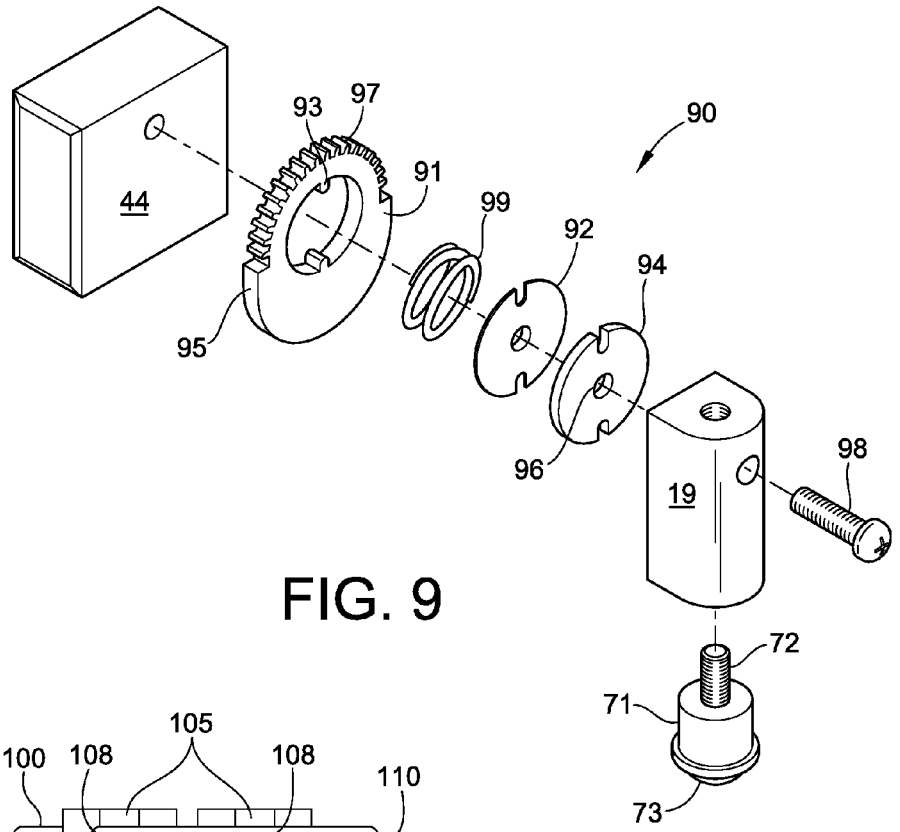
FIG. 9 depicts a third embodiment of a foot useful for holding a post in place.

FIG. 9 depicts another embodiment of an easily-released stop for the post. Brake 90 mounts to foot 44 between the foot and roller bearing caster mount 19. This roller bearing includes only the housing 71, mounting bolt 72, and the bearing itself 73, as described above. Brake 91 includes mounting tabs 93, bottom surface or brake 95 and roughened surface 97. Brake 91 mounts upon pivot 92 and slots 94 with tabs 93. Pivot 92 also includes central orifice 96 for mounting to foot 44. Not seen in FIG. 9, the interior of mount 19 provides tabs similar to those of the brake for mounting on pivot 92. The assembly including mount 19, pivot 92 and brake 91, mounts to foot 44 via threaded fastener 98. The bottom surface 97 of brake 91 provides the braking force when at rest on the floor.

Bottom surface 97 is oriented at 90° to the caster bearing. Thus, one needs only to rotate mount 19 counter clock wise to remove the caster bearing from the floor and place the braking surface 93 onto the floor. A roughened surface 97 is provided on the brake 91 to enable a user's foot to rotate the assembly and thus to brake or to release the foot. A coil spring 99 may also be used to assist in rotation or to provide tactile feedback to a user. A coil spring would mount between pivot 92 and foot 44.

Figure 10:
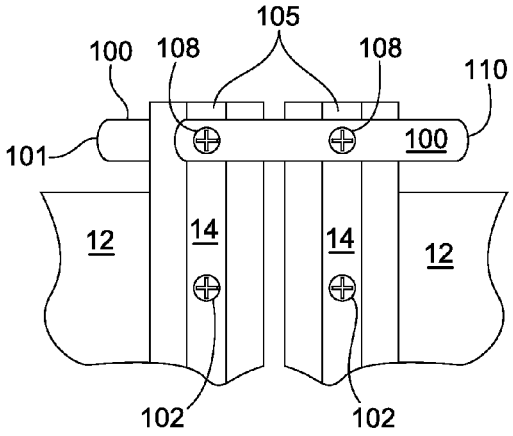
FIGS. 10-11 depict embodiments of connectors used to secure posts or feet to each other to form a modular portable writing and projection system having variable curvature.

The elevation or side view of FIG. 10 depicts equipment and a method to join two posts and the panels they support. In FIG. 10, panels 12 are joined to posts 14 with fasteners 102 through orifices in the panels and posts (not shown in FIG. 10). In this embodiment, the posts 14 have additional orifices 105 near their tops, the orifices used to accommodate fasteners 108 and connectors 100. The connectors may be any desired, but in this embodiment, they are merely two strips of rubber, longer than necessary so that a user may grasp the connector by tab 101 for assembly to the posts. In this embodiment, the front connector has a tab oriented to the right; the identical connector in the rear has a tab oriented to the left.

Figure 11:
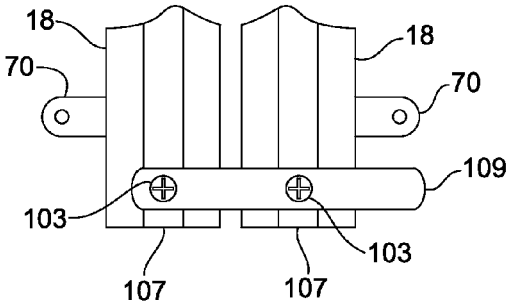

The plan or top view of FIG. 11 depicts equipment and a method to join two feet together. In this embodiment, feet 18 of two adjacent posts are brought near, the figure depicting the adjacent ball bearing casters 70 of the two feet. Each foot has a top orifice 101 to accommodate fasteners 103 to secure a connecting tab 109. The tab may be made of any convenient suitable material, such as metal, plastic or rubber.

With respect to the second method of maintaining curvature, the module could be provided with an adjustable tightening mechanism. The tightening mechanism could comprise a cable, rope, filament, or the like. The cable could be fastened to the panel or the posts in any number of ways including through eyelets, apertures, or the like. When tightened, the cable would force the bendable panel to bow into a curved configuration. Cable tightening mechanisms may be provided such as a crank, knob, or winch. Further, a dampening release mechanism could also be provided to prevent the panel from violently snapping back to normal when the force exerted by the tightening mechanism is removed.

Referring back to FIG. 1, the modules connect with each other to create a larger, variably-curved surface. The modules could be secured together by clamping the supports together or by providing the surface of the supports with a cooperative interlocking geometry that would enable the posts to be secured to one another. Any number of geometries could be used, however, some examples include snaps, tabs and receiving apertures, and mortise and tenon joints. For example, raised buttons on the feet could be used with slitted plastic or rubber connectors to secure the posts to each other.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

While embodiments of the invention have been disclosed and described in detail, it is understood that various modifications and improvements thereon will become readily apparent to those skilled in the art. Accordingly, the spirit and scope of the present disclosure is not limited by the foregoing examples, but is better understood by the claims below.

What is claimed is:

1. A portable and modular board writing system, comprising:

a flexible panel having a first edge and a second edge, the flexible panel made from a material selected from the group consisting of a hardboard, a thermoplastic material and thermoset material;

a smooth surface adapted for non-permanent writing on at least one side of the flexible panel;

a first post secured to the first edge of the flexible panel;

a second post secured to the second edge of the flexible panel, the first and second posts secured directly to the first and second edges of the flexible panel;

a first foot oriented orthogonally to the first post and secured to an end of the first post; and a second foot oriented orthogonally to the second post and secured to an end of the second post, wherein an outer side of each of the first and second posts is adapted to engage with outer sides of a third post of an adjacent flexible panel, wherein the flexible panel and the adjacent flexible panel form a writing system having a variable curvature, the flexible panel and the adjacent flexible panel exerting a force resisting said variable curvature and tending to straighten out the flexible panel and the adjacent flexible panel, and wherein the first and second feet provide sufficient resistance to prevent movement of the feet due to curvature of the panels.

2. The writing system according to claim 1, wherein the smooth surface is applied to, integral with or affixed to the flexible panel.

3. The writing system according to claim 1, wherein the smooth surface is selected from the group consisting of a white dry erase board, a chalk board, and an opaque layer of flexible plastic.

4. The writing system according to claim 1, wherein the feet are provided with at least one of (a) a material of sufficient weight to maintain curvature of the panel when the feet are in contact with the ground, (b) stoppers affixed to the feet, and (c) lockable casters affixed to the feet.

5. The writing system according to claim 1, wherein each foot comprises a ball-socket caster and a frictional stop.

6. The writing system according to claim 1, further comprising at least one connector between the first or second post of the flexible panel and the third post of the adjacent flexible panel.

7. The writing system according to claim 1, wherein each of the posts further comprises a foot mechanism selected from the group consisting of a kick-down holder, a plunger-type holder, a braking end cap and a brake.

8. The writing system according to claim 1, wherein the panel and the posts are arranged with the writing surface in a concave orientation, providing a temporary enclosure for a group collaborative effort.

9. The writing system according to claim 1 wherein the panel and the posts are joined to form a writing system having a curvature with a minimum diameter of about 10 feet (about 3 meters).

10. The writing system of claim 1, wherein the writing system with a variable curvature forms a temporary enclosure for a group collaborative effort.

11. The writing system of claim 1, further comprising the adjacent flexible panel, and wherein the variable curvature comprises a single radius.

12. A portable and modular board writing system, comprising:

at least two flexible panels, each having a first edge and a second edge;

a smooth surface adapted for non-permanent writing on at least one side of each flexible panel;

a plurality of posts secured to the first edge and second edge of the at least two flexible panels, wherein the number of posts is equal to the number of flexible panels plus at least one additional post;

a first foot oriented orthogonally to a first post of the plurality of posts and secured to an end of the first post; and a second foot oriented orthogonally to a second post of the plurality of posts and secured to an end of the second post, the first and second posts attached to at least one of the at least two flexible panels, wherein a first edge of a first panel of the at least two flexible panels and a second edge of a second panel of the at least two flexible panels are secured to the second post with no overlap of the first panel with itself and with no overlap of the second panel with itself, and with no overlap of the first panel with the second panel when the first and second panels are secured to the second post, wherein the at least two flexible panels and smooth surfaces form a writing system having a variable curvature, each panel exerting a force counter to the variable curvature and wherein the first and second feet provide sufficient resistance to prevent movement of the feet due to the force.

13. The system according to claim 12, wherein at least one of the plurality of posts is adapted for attachment to two flexible panels.

14. The system according to claim 12, further comprising at least one roller bearing caster operably attached to the first foot or the second foot.

15. The system according to claim 12, wherein each of the posts further comprises a stopping mechanism for holding the post and the writing system in place.

16. The system according to claim 12, wherein at least one of the posts further comprises a manual turn-down mechanism for holding the post and the writing system in place.

17. The system according to claim 12, further comprising a plurality of connectors for securing the posts to the edges.

18. A method for providing a modular, portable writing and projection system having variable curvature, the method comprising:

providing at least two flexible panels, each flexible panel having left and right edges, a base layer and an outer layer having a smooth surface adapted for non-permanent writing on at least one side of the flexible panels;

securing posts to the left and right edges of each panel, each post having a foot oriented orthogonally to the post, the posts secured directly to the at least two panels through pre-formed orifices in the posts and the panels;

mounting a stopping or securing mechanism to each foot; and arranging the panels, posts and feet to form a system with a desired curvature, the panels exerting a force resisting said desired curvature and tending to straighten out the panels, wherein the feet provide sufficient resistance to prevent movement of the feet due to curvature of the panels.

19. The method of claim 18, further comprising using a single post to secure a right edge of a first flexible panel and a left edge of an adjacent flexible panel.

20. The method of claim 18, wherein the step of arranging is used to form a convex structure or a concave structure.

21. The method of claim 18, further comprising arranging the panels and posts to form a concave enclosure of at least 180°, providing a temporary enclosure for a group collaborative effort.

22. The method of claim 18, further comprising fasteners for securing the posts to the at least two panels through the pre-formed orifices.

23. The method of claim 18, further comprising using a first post to secure a right side edge of a first flexible panel and a second post to secure a left side edge of an adjacent flexible panel.

24. The method of claim 23, further comprising securing the first post to the second post using a connector.

* * * * *